US007770335B2

(12) United States Patent
Evensen

(10) Patent No.: US 7,770,335 B2
(45) Date of Patent: Aug. 10, 2010

(54) ROTATIONAL ROOF JACK

(76) Inventor: Lawrence P. Evensen, 2020 Broomfirth Ct., Westlake Village, CA (US) 91361

( * ) Notice: Subject to any disclaimer, the term of this patent is extended or adjusted under 35 U.S.C. 154(b) by 337 days.

(21) Appl. No.: 11/155,791

(22) Filed: Jun. 17, 2005

(65) Prior Publication Data

US 2006/0283100 A1 Dec. 21, 2006

(51) Int. Cl.
*E04D 1/36* (2006.01)

(52) U.S. Cl. ..... 52/60; 52/219

(58) Field of Classification Search ..... 52/58, 52/60–62, 198, 219, 220.08; 285/42–44, 285/46; 126/315, 317
See application file for complete search history.

(56) References Cited

U.S. PATENT DOCUMENTS

| | | | | | |
|---|---|---|---|---|---|
| 791,068 | A * | 5/1905 | Baker | 285/43 |
| 1,379,233 | A * | 5/1921 | Wilcke | 126/317 |
| 2,821,900 | A * | 2/1958 | Primich | 454/3 |
| 3,708,185 | A * | 1/1973 | Bilicki et al. | 285/42 |
| 4,407,023 | A * | 10/1983 | Norton | 285/46 |
| 4,453,562 | A * | 6/1984 | Palkovics | 137/382 |
| 4,490,954 | A * | 1/1985 | Cresti | 52/220.8 |
| 4,635,409 | A * | 1/1987 | Vandemore | 52/60 |
| 5,079,389 | A * | 1/1992 | Nelson | 174/505 |
| 5,661,891 | A * | 9/1997 | Miller et al. | 29/453 |
| 5,970,667 | A * | 10/1999 | Thaler | 52/219 |
| 6,601,351 | B1 * | 8/2003 | Zerfoss | 52/198 |
| 6,705,050 | B2 * | 3/2004 | Nichols, Jr. | 52/62 |

* cited by examiner

*Primary Examiner*—Robert J Canfield
*Assistant Examiner*—Christine T Cajilig
(74) *Attorney, Agent, or Firm*—McAndrews, Held & Malloy, Ltd.

(57) ABSTRACT

A roof jack apparatus for sealing openings in roofs through which penetrating conduits may pass. The apparatus includes an inner jack and outer jack. The inner jack may include an inner collar, a first flange, and an inner door. The outer jack may include an outer collar, a second flange, and an outer door. A portion of the inner jack may be inserted into at least a portion of the outer jack. The inner and/or outer jack may be rotated about each other. When rotated so that the first door is aligned with the second door, a passageway may be opened that allows the roof jack apparatus to be slid across the sides of the conduit and into position. The passageway may then be closed by rotating the inner and/or outer jack so that the first and second door are no longer aligned, thereby closing the passageway.

22 Claims, 11 Drawing Sheets

ROTATIONAL ROOF JACK

BACKGROUND OF THE INVENTION

The construction and installation of roofs or coverings over various types of commercial, residential, and recreational structures often have to accommodate openings that may be configured to permit the penetration of conduit, piping, and vents, among other types of penetrations (hereinafter collectively referred to as "conduit"), into, and/or out of, the associated structure. For example, the roof of a residential home may include openings for ventilation piping or ducts, electrical conduit, air conditioning lines, and various mechanical support structures. Cable and wire, such as power and phone lines, may pass through the conduit and into, or out of, the associated structure. Unfortunately, the presence of such openings in the roof compromise the ability of the roof to protect the interior of the structure from undesirable environmental elements such as, for example, water or intruding insects.

In the past, these openings may have been protected, in part, from undesirable moisture through the use of a roof jack, also known as a roof flashing. A roof jack may be configured to create a water-tight seal between the outer portion of the conduit and the opening in the roof. Known roof jacks may include a tubular sleeve portion that fits around the outside walls of the penetrating conduit, and a flange that covers the opening in the roof. The flange may abut against at least a portion of the roof, or associated roofing materials, such as shingles, tile, and tar, among others and may be operably secured to the roof through the use of an adhesive material, or a mechanical fastener, such as a nail. Further, at least a portion of the flange may be covered by roofing materials, which may further assist in preventing water or insects from entering into the opening in the roof. To further assist in the creation of a water-tight seal about the opening, caulk or other sealants may be applied to close gaps between portions of the roof jack and the abutting penetrating conduit and/or roof.

One form of roof jack known in the art employs a female collar that has a non-split configuration that may be shaped to slide over the penetrating conduit. The use of a non-split configuration may require that the conduit have an accessible end at which the collar may be placed over, and subsequently slid down along, the outside of the conduit. However, in many applications, the end of the penetrating conduit, or wires or cables passing therethrough, may be attached to other devices, equipment, or structures. For example, electrical wiring may pass through the conduit and onto utility pools, whereupon the wiring may be operably connected to provide utility services to the associated structure. In such a case, an electrician may be required to disassemble the electrical wiring to the home so that the female collar of the roof jack may be placed over, and slid down, the conduit. The time and labor required to disassemble and re-assemble such connections so that the roof jack may be placed over the conduit may not only be time consuming and expensive, but may also delay the progress of other scheduled construction tasks, and may thus further increase labor costs.

Recognizing the limitations of non-split roof jack designs, other known roof jacks have employed split collars. One type of split collar design may employ a single slit along a side of the roof jack. When the roof jack is in a closed position, the width of the slit may be narrow so that the edges of the roof jack that are separated by the slit may abut, overlap, or be in close proximity to each other. However, when the roof jack is in an open position, the edges of the roof jack separated by the slit may be pulled apart from each other, thereby increasing the width of the slit so as to create an opening that may allow the roof jack to be slid around the sides of the conduit and placed in positioned about the conduit. Once positioned around the conduit, the separate edges may then be pushed or pressed together so that the slit is generally closed. This split collar design, however, is disadvantageous in that the slit allows for imprecision and for the potential of an inadequate seal from the elements. Moreover, this "slit" design may be made only of a limited number of materials.

Other known roof jacks may incorporate a collar that may consist of at least two separate removable segments. In such a case, the collar may be assembled about the conduit by positioning each individual segment around at least a portion of the conduit. Once positioned about the conduit, each segment may be secured to a mating segment. Such devices may allow the roof jack to be positioned about the conduit regardless of whether the end of the conduit, wires and cables passing therethrough, is connected to other equipment or devices. Yet, securing the assembled individual segments together may require additional materials, time, and/or equipment. More specifically, the joining of the mating segments may require that the segments be sealed, soldered, welded, and/or bolted together, which may be time consuming and thus may increase expenses.

BRIEF SUMMARY OF THE INVENTION

The present invention pertains to an apparatus for covering openings in roofs created for the passageway of penetrating conduit. More particularly, the present invention pertains to a roof jack apparatus that may be placed around the penetrating conduit without requiring that the conduit, or wires or cables passing therethrough, be disassembled from any connected devices or equipment. The roof jack may be constructed to work on a variety of flat and sloped roofs.

The rotational roof jack of the present invention includes an inner jack and an outer jack. The inner jack may include an inner collar and a first flange. The inner jack may have a uni-body construction. Alternatively, the inner collar may be operably secured to the first flange. The inner collar may include an inner wall and an outer wall. The inner jack may also include an opening or gap that provides an inner door that may run along the inner collar and the first flange, and which may be sized to allow the inner jack to be slid across the sides of the conduit. Further, the inner door may include an upper inner gap along the inner collar and a lower inner gap along the first flange. In one embodiment, the upper and lower inner gaps may have the same general configuration (i.e. width and/or shape). However, in another embodiment, the size and shape of the opening of the upper inner gap along the inner collar may be different than that of the lower inner gap.

The outer jack may include an outer collar and a second flange. The outer collar may include an interior wall and an exterior wall. The outer jack may also have a uni-body construction, or may be formed by the operable connection of the outer collar to the second flange. The outer jack may also have an outer door, which may include an upper outer gap along the outer collar and a lower outer gap along the second flange. The outer door may also be sized to allow the outer jack to be slid across the sides of the conduit. The outer door may also have a configuration similar to that of the inner door.

At least a portion of the inner jack may be inserted into at least a portion of the outer jack. For example, at least a portion of the outer wall of the inner jack and the interior wall of the outer jack may be sized so that at least a portion of the inner collar may be rotatably inserted into the outer collar. The inner jack may be rotated about the outer jack. Alternatively, the outer jack may be rotated about the inner jack. The ends of the second flange may be bent, turned, shaped, or crimped inwardly so as to create a channel that may assist in guiding the rotational movement of the inner jack, and which may also assist in preventing the separation of the outer collar from the inner collar. At least a portion of the inner or outer collar may also be bent, shaped, or turned to cover at least a portion of the top portion of the adjacent collar so as to also assist in creating a water seal or barrier between the inner and outer collars.

The rotational movement of the inner jack and/or the outer jack may allow the rotational roof jack to be moved into an open or closed position. When in an opened position, the opening of the inner door along the inner jack may be generally aligned with the opening of the outer door along the outer jack so as to create an opened passageway along which at least a portion of the rotational roof jack may be slid across the sides of the conduit. Once in position, the inner jack and/or the outer jack may be rotated so that the opening of the inner door is not aligned with the opening of the outer door. By misaligning the inner and outer doors, the passageway through which the rotational roof jack may be slid across the sides of the conduit may be closed, thereby preventing the rotational roof jack from being slid off of the adjacent conduit.

Figure 1:
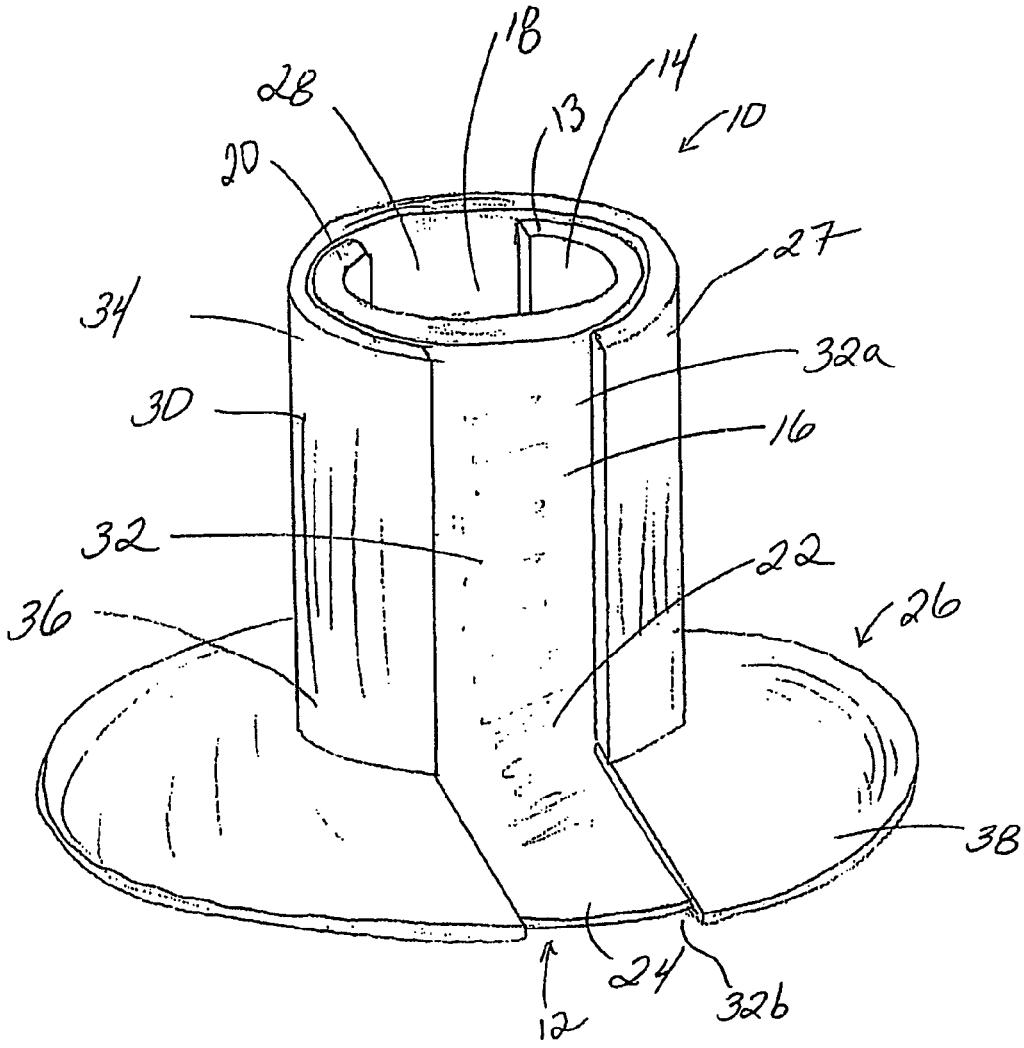
FIG. 1 illustrates a perspective view of a rotational roof jack according to an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentalities shown in the attached drawings.

DETAILED DESCRIPTION OF THE INVENTION

FIG. 1 illustrates a perspective view of a rotational roof jack 10 according to an embodiment of the present invention. The rotational roof jack 10 may include an inner jack 12 and an outer jack 26. The rotational roof jack 10 may be constructed from a variety of materials, including, but not limited to, sheet metal, galvanized steel, copper, aluminum, lead, plastic, rubber, and polymers, along with other Farris and non-Farris materials. Further, the size of the roof jack 10 may be based on the particular application, such as the size of the conduit or opening in the roof. For example, the roof jack 10 may vary from ½ inch to more than 24 inches in diameter.

At least a portion of the inner jack 12 may be configured for insertion into, and rotational movement about, at least a portion of the outer jack 26. The inner jack 12 may include an inner collar 13 and a first flange 24. The inner collar 13 may include an inner wall 14, an outer wall 16, a proximate end 20, and a distal end 22. The first flange 24 may be operably connected to the distal end 22 of the inner collar 13. For example, with some materials, the first flange 24 may be operably connected to the inner collar 13 through welding, soldering, an interference fit, mechanical fasteners, or adhesives. Alternatively, the inner jack 12 may be formed or molded to have a uni-body or may have a hybrid construction.

Figure 5:
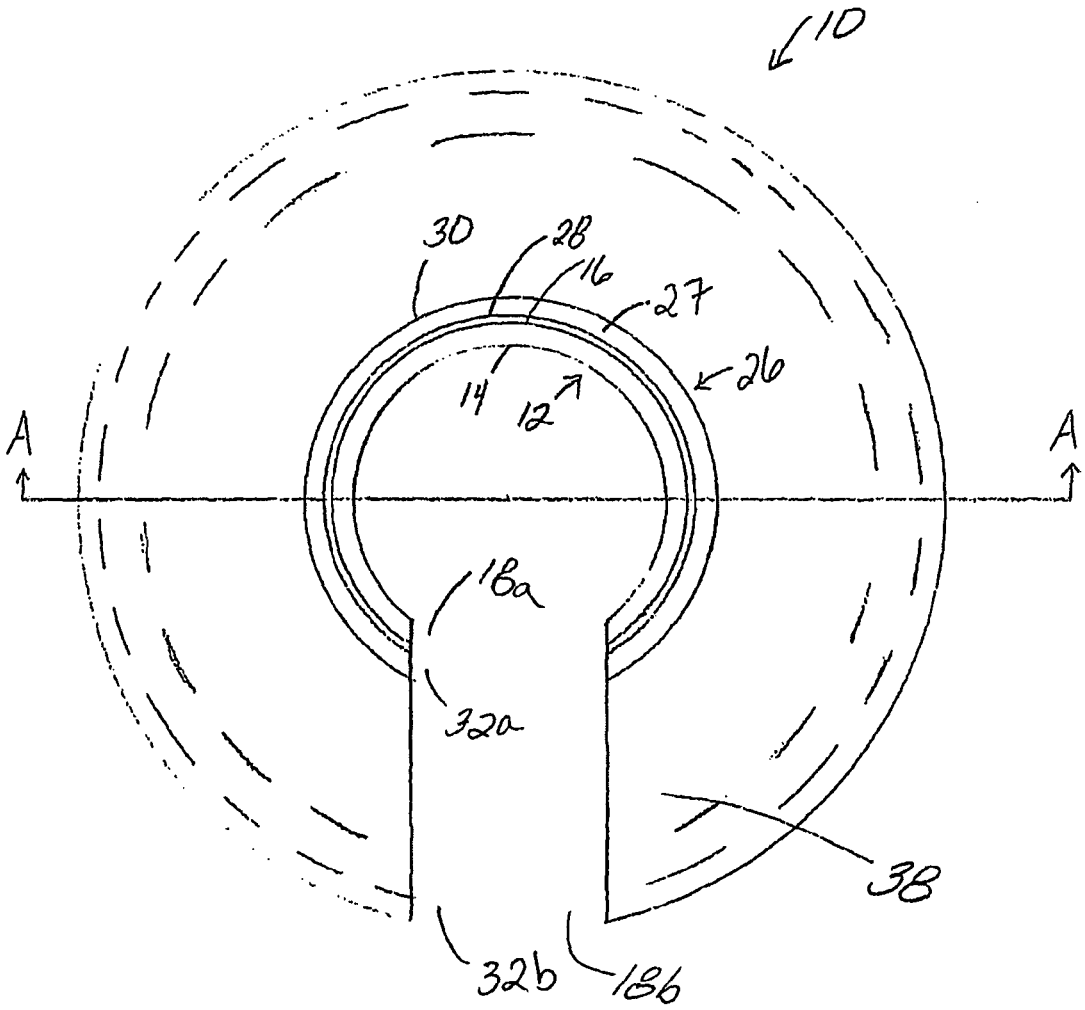
FIG. 5 illustrates a top view of a rotational roof jack in an open position according to an embodiment of the present invention.

As shown in FIGS. 1 and 5, an inner door 18 may run along both the inner collar 13 and the first flange 24 so as to create a passageway that may allow the inner jack 12 to be slid across the sides of a conduit. The inner door 18 may include an upper inner gap 18*a* along the inner collar 13 and a lower inner gap 18*b* along the first flange 24. The configuration of the gaps provided by the inner door 18 along the inner collar 13 and first flange 24 may be based on the size and/or shape of the conduit.

The outer jack 26 may include an outer collar 27 and a second flange 38. The outer collar 27 may include an interior wall 28, an exterior wall 30, a first end 34, and a second end 36. The second end 36 of the outer jack 26 may be operably connected to the second flange 38 in a manner similar to those discussed for the inner jack 12 and first flange 24. Alternatively, the outer jack 26 may have a uni-body or hybrid construction.

Similar to the inner door 18, the outer door 32 may include an upper outer gap 32*a* that extends down across the sides of the outer collar 27 and a lower outer gap 32*b* along the second flange 38. The outer door 32 may be configured so that a passageway may be created in the outer jack 26 that may allow the outer jack 26 to be slid across the conduit.

As shown in FIG. 1, the inner wall 14 of the inner collar 13 may be configured to provide an open space which may be occupied by at least a portion of a conduit (not shown). Although the inner wall 14 is shown in FIG. 2 as having a semi-circle profile, the shape of the inner wall 14 may be designed so that the rotational roof jack 10 may positioned about an assortment of conduit configurations or conduit support structures, including, but not limited to, round tubing, angle iron, and square or rectangular tube supports.

The outer wall 16 of the inner collar 13 may be sized relative to the interior wall 28 of the outer collar 27 so that at least a portion of the inner collar 13 may be inserted into at least a portion of the outer collar 27. The outer and interior walls 16, 28 may be configured so that the inner jack 12 may be rotated about the outer jack 26, or, alternatively, the outer jack 26 may be rotated about the inner jack 12. In one embodiment, the inner jack 12 may be rotated about the outer jack 26 by turning either the first flange 24 or the inner collar 13.

Figure 2:
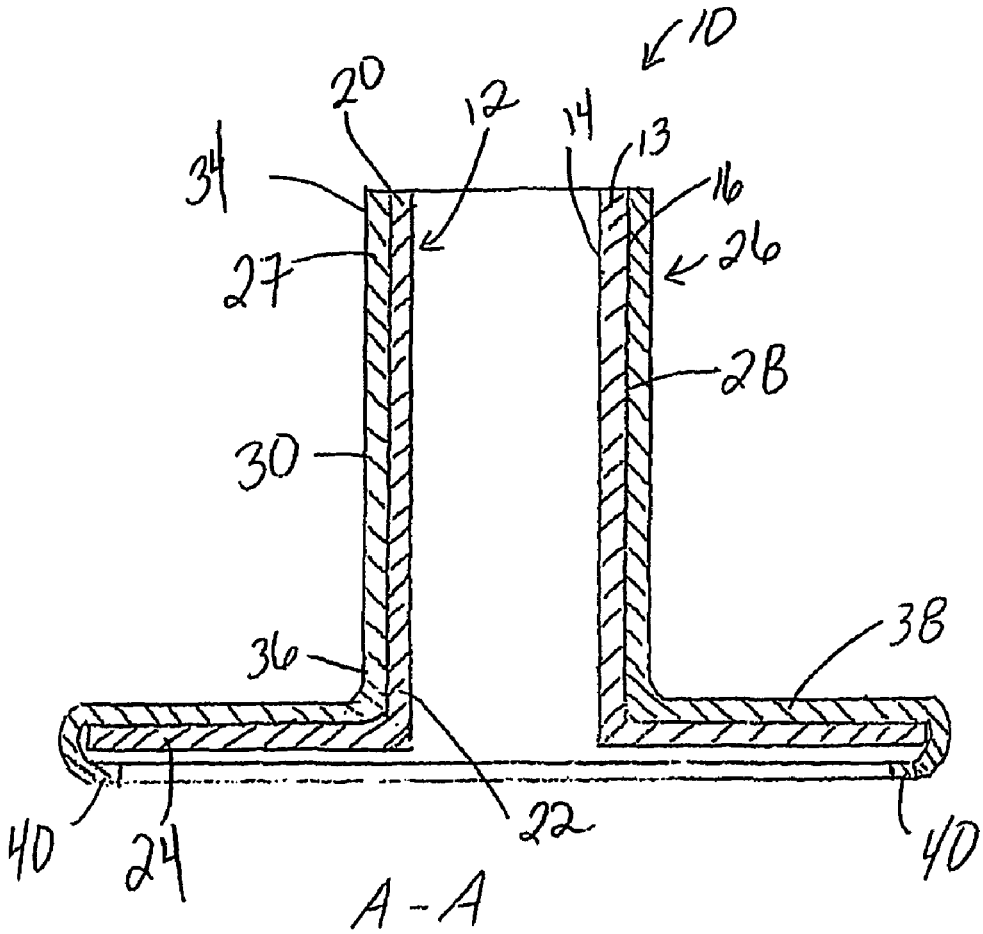
FIG. 2 illustrates a cross sectional view of a rotational roof jack according to an embodiment of the present invention.

FIG. 2 illustrates a cross sectional view of a rotational roof jack 10 according to an embodiment of the present invention. As shown, at least a portion of the inner collar 13 may fit within at least a portion of the outer collar 27. As previously mentioned, the outer wall 16 of the inner collar 13 may be sized to both fit within the interior wall 28 of the outer collar 27, and, when the inner and outer jacks 12, 26 are assembled, allow at least one collar 13, 27 to rotate about the other collar 13, 27.

When the inner and outer jacks 12, 26 are assembled, at least a portion of the first flange 24 may be positioned beneath at least a portion of the second flange 38. After the inner jack 12 has been operably positioned inside the outer jack 26, at least a portion of the ends of the second flange 38 may be shaped, bent, turned, or crimped at least generally inwardly so as to create a lip 40 that may provide a channel that may guide the rotational movement of either the first or second flange 24, 38 relative to the other flange 24, 38, and may also prevent the first and second jacks 12, 26 from being separated from each other.

Figure 3:
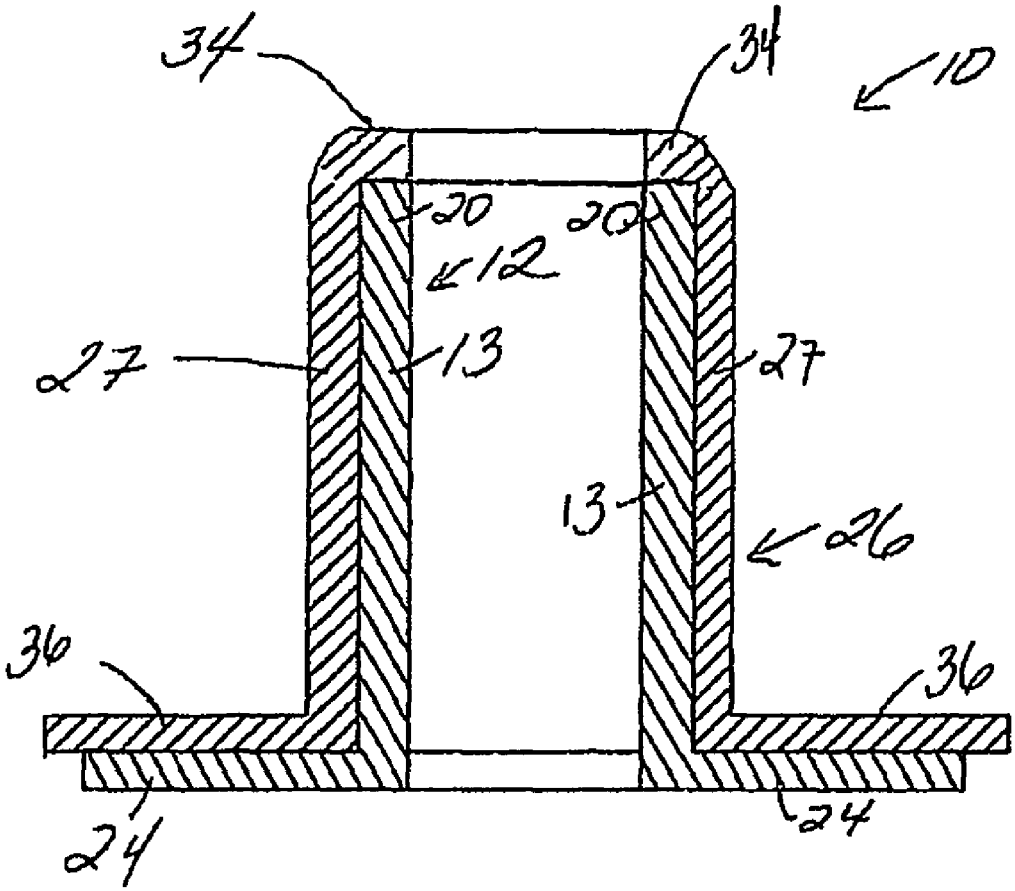
FIG. 3 illustrates a cross sectional view of a rotational roof jack according to an embodiment of the present invention in which at least a portion of the first end of the outer collar is positioned above at least a portion of the inner collar.

FIG. 3 illustrates a cross sectional view of a rotational roof jack 10 according to an embodiment of the present invention in which at least a portion of the first end 34 of the outer collar 27 is positioned above at least a portion of the inner collar 13. As shown, the first end 34 may be positioned above the proximate end 20 of the inner collar 13. The region of the outer collar 27 in proximity to the first end 34 may be turned, shaped, bent, or crimped generally inwardly so as to cover at least a portion of the proximate end 20 of the inner collar 13. By covering at least a portion of the proximate end 20 of the inner collar 13, the first end 34 of the outer collar 27 may assist in creating a shield or seal against water entering into the roof jack 10 between the inner jack 12 and outer jack 26, and subsequently through the opening in the roof.

Figure 4:
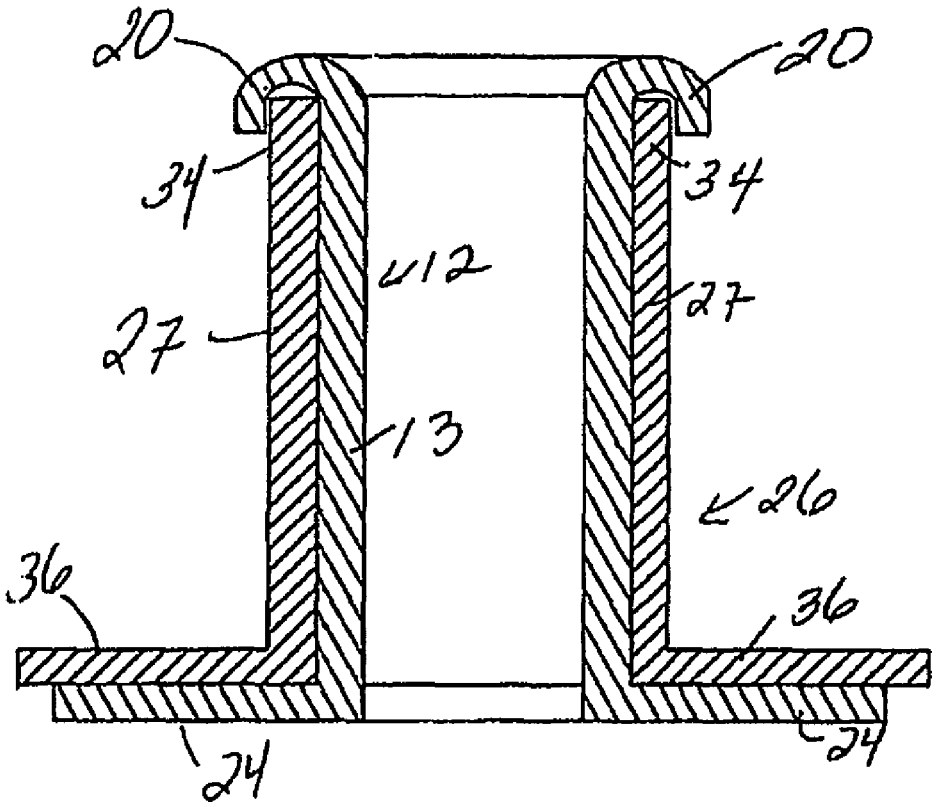
FIG. 4 illustrates a cross sectional view of a rotational roof jack according to an embodiment of the present invention in which at least a portion of the proximate end of the inner collar is positioned above at least a portion of the outer collar.

FIG. 4 illustrates a cross sectional view of a rotational roof jack 10 according to an embodiment of the present invention in which at least a portion of the proximate end 20 of the inner collar 13 is positioned above at least a portion of the outer collar 27. In such an embodiment, at least a portion of the proximate end 20 may be bent, shaped, or crimped about at least a portion of the first end 34 of the outer collar 27 so as to assist in creating a shield or seal against water entering into the roof jack 10 between the inner jack 12 and outer jack 26. In such an embodiment, the portion of the proximate end 20 of the inner collar 13 that extends beyond the first end 34 of the outer collar 27, may improve accessibility to the inner jack 12, thereby improving the ability to spin the inner jack 12 via the inner collar 13 rather than from the first flange 24.

FIG. 5 illustrates a top view of a rotational roof jack 10 in an open position according to an embodiment of the present invention. As shown, when the rotational roof jack 10 is in an opened position, both the inner door 18 and the outer door 32 of the inner and outer jacks 12, 26, respectively, are generally aligned. By aligning the inner and outer doors 18, 32, a passageway may be created through which the rotational roof jack 10 may be slid across the conduit.

Figure 6:
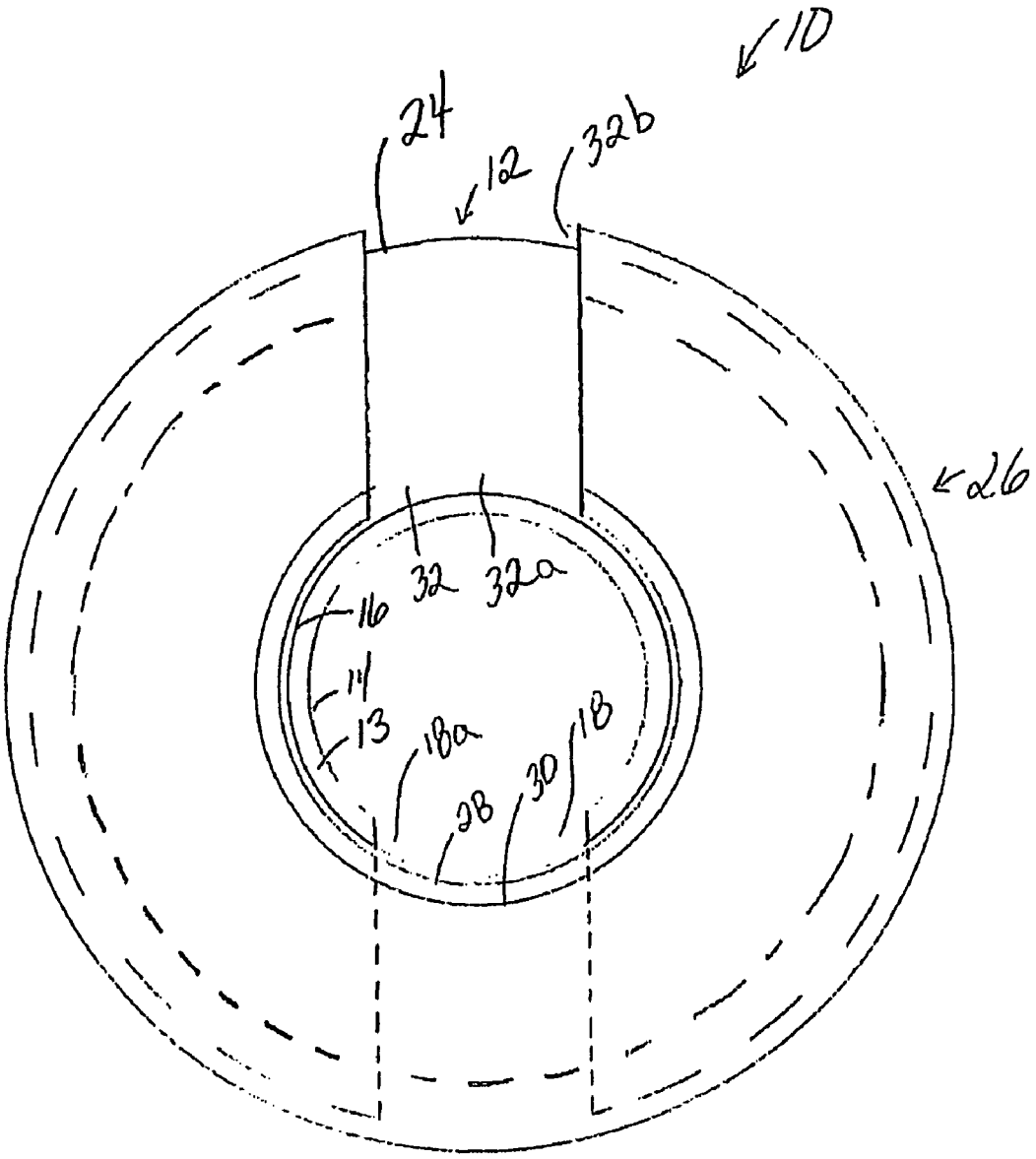
FIG. 6 illustrates a top view of a rotational roof jack in a closed position according to an embodiment of the present invention.
Figure 7:
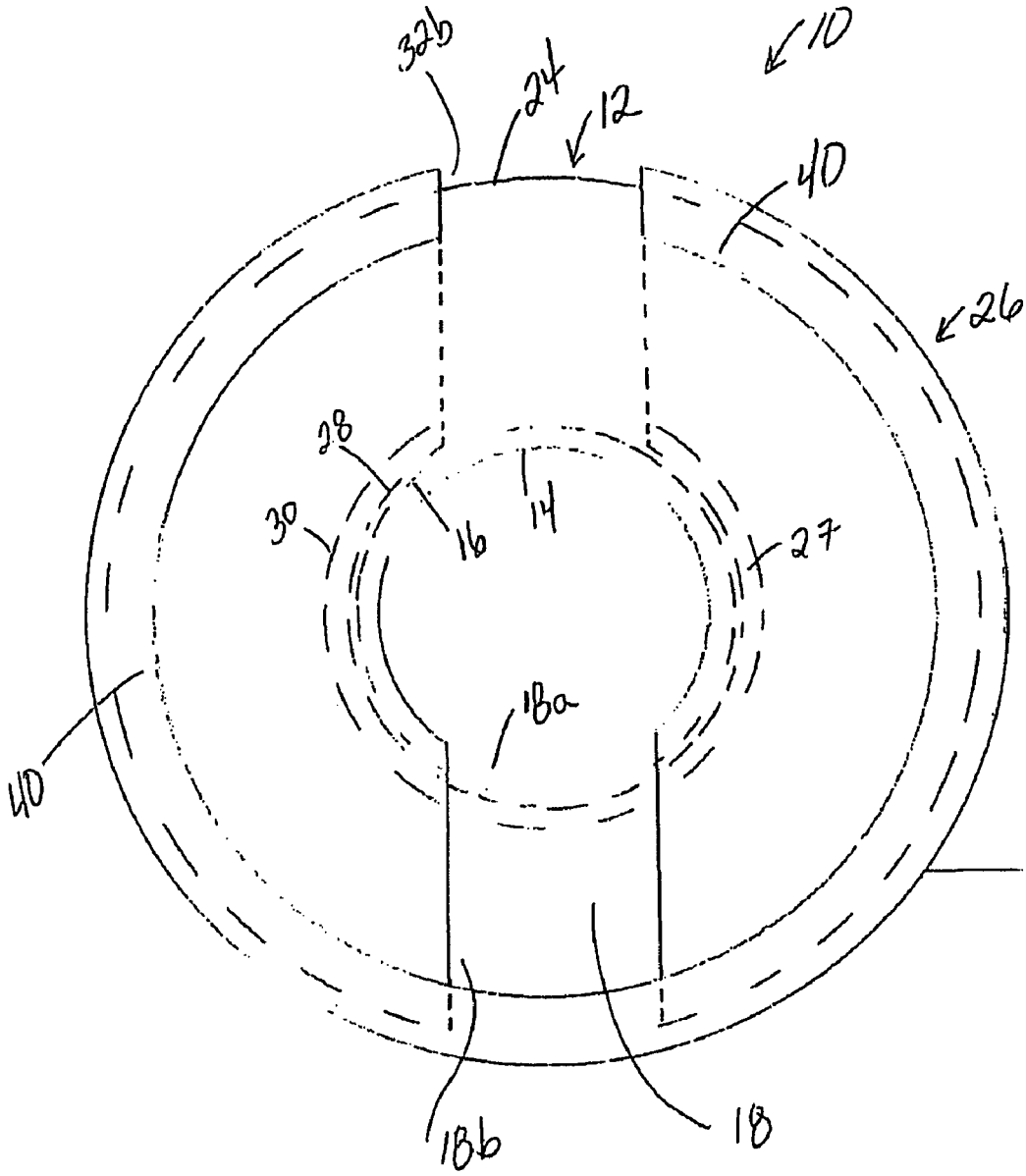
FIG. 7 illustrates a bottom view of a rotational roof jack in a closed position according to an embodiment of the present invention.

FIGS. 6 and 7 illustrate a top and bottom view, respectively, of rotational roof jacks 10 in closed positions according to embodiments of the present invention. As shown, the inner door 18 may be broken into an upper inner gap 18*a* and a lower inner gap 18*b* that run along the inner collar 13 and the first flange 24 respectively. Further, the outer door 32 may include an upper outer gap 32*a* along the outer collar 27 and a lower outer gap 32*b* along the second flange 38. After the rotational roof jack 10 has been positioned about the conduit, the rotational roof jack 10 may be closed by rotating the inner and/or outer jack 12, 26. For example, the bottom of the first flange 24 may be spun so as to rotate the inner jack 12 about the outer jack 26, thereby changing the position of the opening of the inner door 18 relative to the position of the opening of the outer door 32. The changes in the positions of the inner and outer doors 18, 32 may cause the upper inner and outer gaps 18*a*, 32*a* in both the inner and outer collars 13, 27, and at least a portion of the lower inner and outer gaps 18*b*, 32*b* of the first and second flanges 24, 38, to be misaligned, or closed, so that the conduit may not be slid out of, or into, the rotational roof jack 10.

By way of example, FIGS. 6 and 7 illustrate the inner and doors 18, 32 as being approximately 180 degrees from each other when the roof jack 10 is in a closed position. However, as would be understood by one of ordinary skill in the art, when in a closed position, the inner and outer doors 18, 32 may located at a variety of positions relative to each other so long as the inner and outer doors 18, 32 do not overlap to create an opening through which the roof jack 10 may be moved onto or off of the conduit.

During installation of the roof jack 10, the inner door 18 and outer door 32 may be positioned relative to each other so as to further assist in preventing moisture from entering into the roof jack 10. For example, in sloped roof applications, the roof jack 10 may be positioned so that, when in a closed position, the outer door 32 along the outer jack 26 is positioned on the down hill side of the slope. This positioning of the outer door 32 may assist in keeping water flowing down the sloped roof away from the outer door 32. Although the down hill positioning of the outer door 32 may result in the inner door 18 being positioned uphill, the inside door 18 is covered by the outer jack 26, which may therefore prevent water from entering into the roof jack 10 through the first door 18. For some sloped roof applications, the roof jack 10 may have an overall height of approximately three inches.

When in a closed position, the opening in the outer jack 26 created by the upper outer gap 32*a* along the second flange 38 may be caulked or sealed so as to assist in preventing moisture or insects from entering into the rotational roof jack 10. For example, a mastic may be used underneath the roof jack 10 as a sealant. Further, at least a portion of the lower outer gap 32*b* in the second flange 38 may be covered by roofing materials, such as, but not limited to, shingles, tile, or tar. Additionally, a cover, such as a storm collar, skirt, umbrella, or cap, may be slid across a portion of the conduit, and may be configured to fit over at least the top of the proximate and first ends 20, 34 of the inner and outer collars 13, 27 respectively. For example, known storm collars in the art may have an opening or slit that, when pulled open, may provide an opening that is wide enough to allow the cover to be slid across the sides of the conduit and onto the top of the rotational roof jack 10.

Once properly positioned over the hole in the roof and closed about the conduit, the rotational roof jack 10 may be secured to the roof through the use of a mechanical fastener, such as a screw or nail, or an adhesive material, including glue, mastic, and cement. For example, when securing the roof jack 10 to a roof through the use of standard roofing nails, the nails may pierce through both the first and second flanges 24, 38, thereby securing the inner and outer jacks 12, 26 in position. Further, some adhesives, such as mastic, may be used to both secure the roof jack 10 in position and assist in creating a seal between the roof and the roof jack 10. The roof jack 10 may also be secured by heat welding the roof jack 10 in position.

Figure 8:
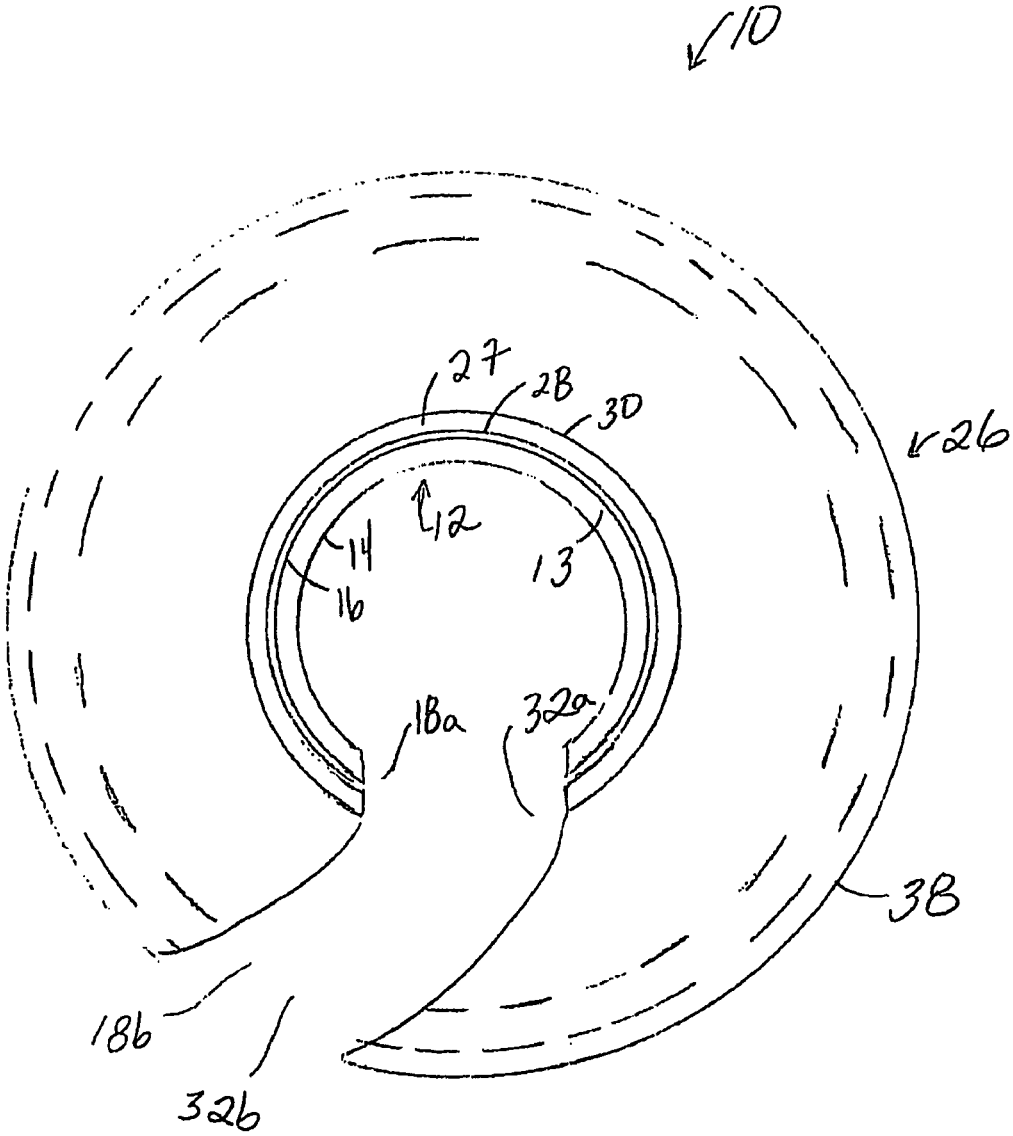
FIG. 8 illustrates a top view of a rotational roof jack in an opened position according to an embodiment of the present invention.

As shown in FIG. 8, in another embodiment of the invention, the openings along the lower inner and outer gaps 18*b*, 32*b* of the first and second flanges 24, 38 may not have the same general configuration as the corresponding openings along the upper inner and outer gaps 18*a*, 32*a* of the inner and outer collars 13, 27. For example, as shown, the lower inner and outer gaps 18*b*, 32*b* may both have a similar winding or diagonal configuration, while the upper inner and outer gaps 18*a*, 32*a* are generally rectangular. In such an embodiment, the rotational roof jack 10 may need to be turned or twisted as the first and second flanges 24, 38 are slid along the inner and outer gaps 18*b*, 32*b* and across the sides of the conduit.

Figure 9:
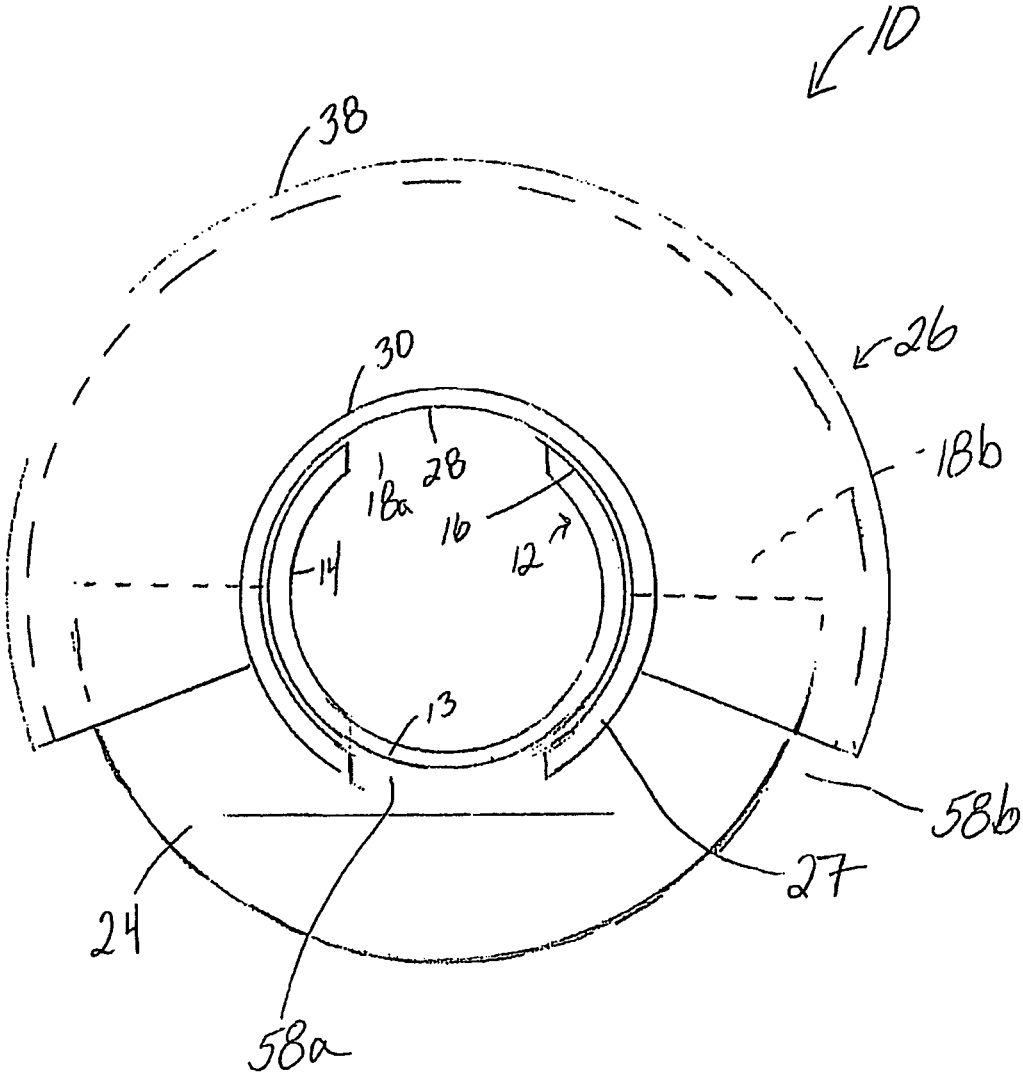
FIG. 9 illustrates a top view of a rotational roof jack in a closed position according to an embodiment of the present invention.

FIG. 9 illustrates a top view of a rotational roof jack 10 in a closed position according to an embodiment of the present invention. As previously mentioned, the size and shape of the openings of the upper inner and outer gaps 18*a*, 32*a* may not resemble the size or shape of the openings of the lower inner and outer gaps 18*b*, 32*b*. For example, the first flange 24 may generally have a half-circle configuration, which may create a lower inner gap 18*b* that is wider than the upper inner gap 18*a*. In such an embodiment, the second flange 38 may be configured so that, when the rotational roof jack 10 is in a closed position, the second flange 38 may cover the half circle opening created by the shape of the first flange 24, while also overlapping at least a portion of the first flange 24 so as to assist in creating a seal between the first and second flanges 24, 38. As shown, the lower outer gap 32*b* may also have a different configuration than the upper outer gap 32*a*.

Figure 10:
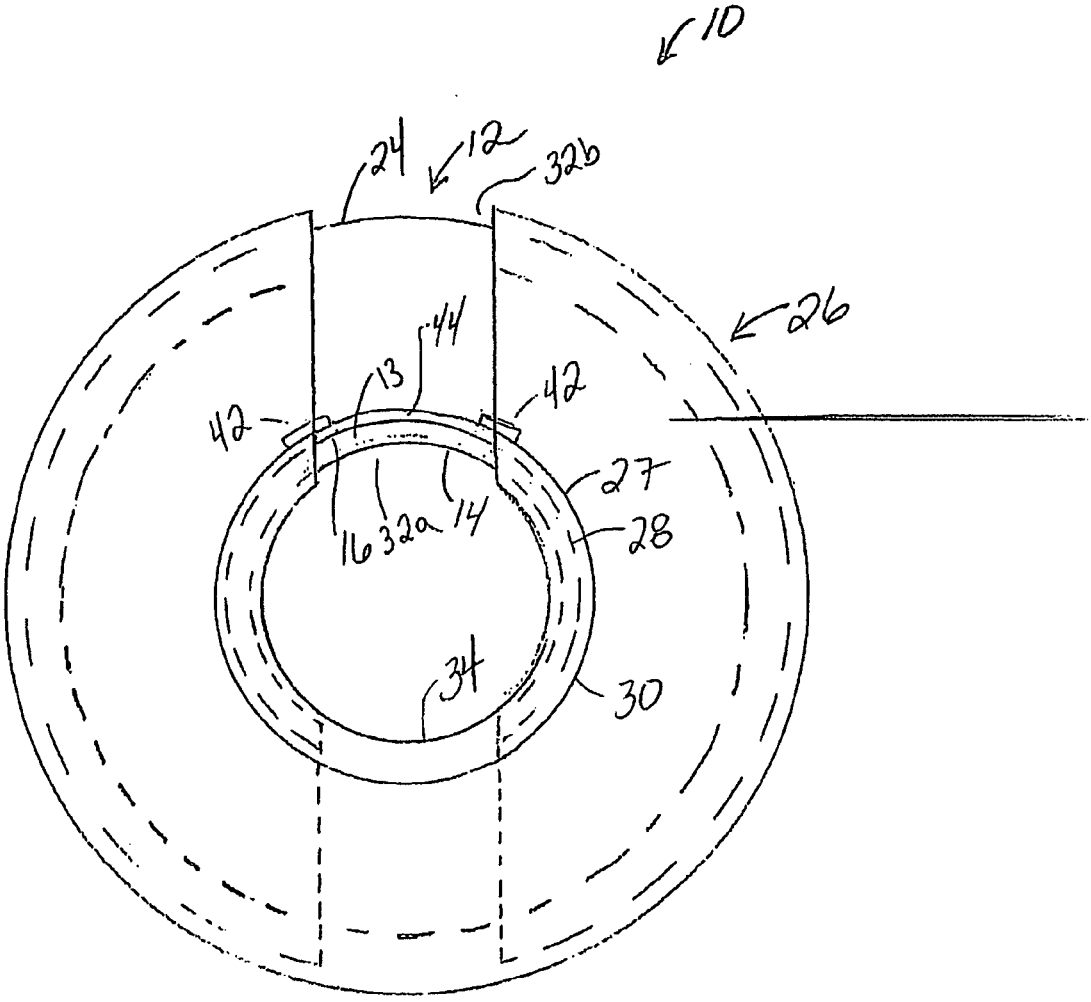
FIG. 10 illustrates a top view of a rotational roof jack in a closed position in which at least a portion of the first end of the outer collar is positioned above at least a portion of the inner collar and which includes at least one gasket in accordance with an embodiment of the present invention.

FIG. 10 illustrates a top view of a rotational roof jack 10 in a closed position in which at least a portion of the first end 34 of the outer collar 27 is positioned above at least a portion of the inner collar 13 and which includes at least one gasket 42 in accordance with an embodiment of the present invention. The gasket 42 may assist in preventing moisture from entering through any gaps along the outer door 32, and, more specifically, between any spaces created by the outer door 32 between the interior wall 28 of the outer collar 27 and the outer wall 16 of the inner collar 13. The gasket 42 may be constructed from, or molded out of, rubber or plastic, among others materials. At least a portion of the gasket 42 may be placed along the exterior wall 30 of the outer collar 27. The gasket 42 may be secured in position about the outer collar 27 through the use of adhesives or mechanical fasteners. For example, the gasket 42 may be molded with holes that are sized to receive the insertion of sheet metal screws that pass into and/or through the gasket 42 and the exterior wall 30.

Additionally, a gate 44 may be positioned along the upper outer gap 32*a* and between the gaskets 42. In such an embodiment, two gaskets may be secured to the edges of the gate 44, through an adhesive or mechanical fasteners. The gate 44 may consist of the material that was removed from the outer collar 27 during the creation of the upper outer gap 32*a*.

The gaskets 42, and any associated gate 44, may be particularly useful for some roof applications, including flat roofs or roofs having low slopes. In such applications, water may have a tendency to accumulate and stand around the roof jack 10. The gate 44 and gaskets 42 may assist in preventing the surrounding water and moisture from entering into the roof jack 10. For such sloped or low sloped roofs, the roof jack 10 may have an overall height of approximately three to twelve inches.

Figure 11:
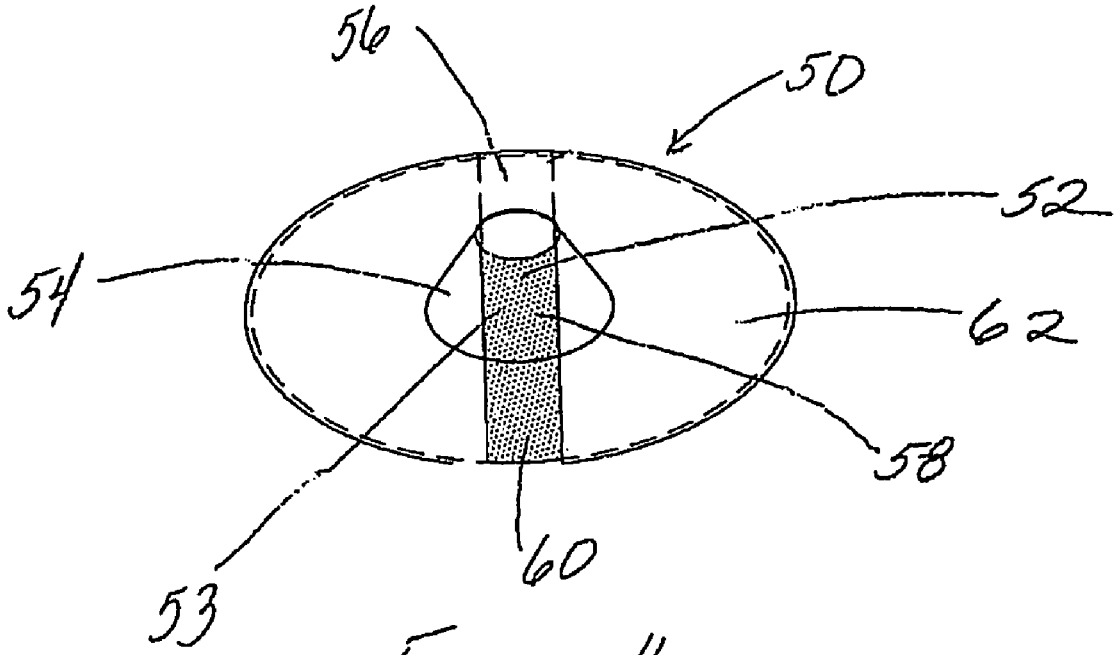
FIG. 11 illustrates a perspective view of a rotational roof jack in a closed position that is configured for placement on a sloped roof according to an embodiment of the present invention.

FIG. 11 illustrates a perspective view of a rotational roof jack 50 in a closed position that is configured for placement on a sloped roof according to an embodiment of the present invention. In some embodiments, the rotational roof jack 50 for a sloped roof may differ from that designed for a flat roof in that the inner and outer collars 52, 54 may need to be configured to accommodate a conical conduit support structure. Thus, at least the inner wall 53 of the inner collar 52 may need to have a conical configuration that may generally conform to the shape of the conduit supports, which may lead to the walls of the inner and outer collars 52, 54 being designed to have conical configurations. As shown in FIG. 11, the rotational roof jack 50 may be in a closed position when the inner and outer collars 52, 54 are rotated so that the inner door 56 and outer door 58 along the inner and outer collars 52, 54 are not aligned. As previously discussed, the misalignment of the openings of the inner and outer doors 56, 58 closes the passageway through which the rotational roof jack 50 may be slid onto or off of the conduit.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

I claim:

1. A rotational roof jack apparatus for providing a seal between a conduit and an opening in a roof comprising:

a. an inner jack having a semi-cylindrical inner collar, a flat first flange extending radially and perpendicularly outward from an end of said inner collar, and an inner door, said inner door providing a first gap along at least a portion of said inner collar and said first flange, said inner door allowing at least a portion of said inner jack to be slid across said conduit, said inner collar having an inner wall configured to receive insertion of at least a portion of said conduit, wherein said inner wall of said inner collar is configured to abut an outer surface of the conduit; and b. an outer jack having a semi-cylindrical outer collar, a second flange extending radially and perpendicularly outward from an end of said outer collar, and an outer door, said outer collar having an interior wall, said outer door providing an outer gap along at least a portion of said outer collar and said second flange, said outer door allowing at least a portion of said outer jack to be slid across said conduit, said interior wall accepting rotational insertion of at least a portion of said inner collar so that at least a portion of said rotational roof jack rotates to generally align or misalign said inner door and said outer door.

2. A roof jack apparatus according to claim 1 wherein said second flange includes a lip configured to provide a channel to guide the rotational movement of said first flange.

3. A roof jack apparatus according to claim 1 wherein said outer collar includes a first end and a second end, at least a portion of said first end of said outer collar being configured to create a channel to assist in the rotational movement of said inner collar.

4. The roof jack apparatus of claim 1 including at least one gasket, said at least one gasket configured to provide a seal between at least a portion of said outer door and said inner collar.

5. The roof jack apparatus of claim 4 including a gate operably connected to said at least one gasket, said gate sized to fit into at least a portion of said outer gap.

6. The roof jack apparatus of claim 1 wherein the inner door is comprised of an upper inner gap and a lower inner gap, said upper inner gap positioned along said inner collar, said lower inner gap positioned along said first flange.

7. The roof jack apparatus of claim 6 wherein said outer door is comprised of an upper outer gap and a lower outer gap, said upper outer gap positioned along said outer collar, said lower outer gap positioned along said second flange.

8. The roof jack apparatus of claim 1 wherein the rotational roof jack is configured for a flat roof.

9. The roof jack apparatus of claim 1 wherein the rotational roof jack is configured for a sloped roof.

10. The roof jack apparatus of claim 1 wherein said inner jack is rotated about said outer jack.

11. The roof jack apparatus of claim 1 wherein said outer jack is rotated about said inner jack.

12. A rotational roof jack apparatus for providing a seal between a conduit and an opening in a roof comprising:

a. an inner jack having a semi-cylindrical inner collar and a flat first flange extending radially and perpendicularly outward from an end of said inner collar, said inner collar having an inner wall, an outer wall, a proximate end, a distal end, and an inner door, said inner door extending across said proximate end to said distal end along said inner collar, said inner door also positioned along said first flange, said inner door providing an opening to allow at least a portion of said inner jack to be slid across at least a portion of said conduit, said inner wall accepting insertion of said conduit; and b. an outer jack having a semi-cylindrical outer collar and a second flange extending radially and perpendicularly outward from an end of said outer collar, said outer collar having an interior wall, an exterior wall, a first end, a second end, and an outer door, said outer door extending across said first end to said second end along said outer collar, said outer door also positioned along said second flange, said outer door providing an opening to allow at least a portion of said outer jack to be slid across at least a portion of said conduit, said interior wall accepting rotational insertion of at least a portion of said inner collar so that at least a portion of said rotational roof jack rotates to generally align or misalign said inner door and said outer door.

13. A roof jack apparatus according to claim 12 wherein said second flange includes a lip configured to provide a channel to assist in the rotation of said first flange.

14. A roof jack apparatus according to claim 12 wherein said outer collar includes a first end and a second end, at least a portion of said first end of said outer collar being configured to create a channel to assist in the rotational movement of said inner collar.

15. The roof jack apparatus of claim 12 including at least one gasket, said at least one gasket configured to provide a seal between at least a portion of said outer door and said inner collar.

16. The roof jack apparatus of claim 12 including a gate operably connected to said at least one gasket, said gate sized to fit into at least a portion of said outer gap.

17. The roof jack apparatus of claim 12 wherein the inner door is comprised of an upper inner gap and a lower inner gap, said upper inner gap positioned along said inner collar, said lower inner gap positioned along said first flange.

18. The roof jack apparatus of claim 12 wherein said outer door is comprised of an upper outer gap and a lower outer gap, said upper outer gap positioned along said outer collar, said lower outer gap positioned along said second flange.

19. The roof jack apparatus of claim 12 wherein the rotational roof jack is configured for a flat roof.

20. The roof jack apparatus of claim 12 wherein the rotational roof jack is configured for a sloped roof.

21. The roof jack apparatus of claim 12 wherein said inner jack is rotated about said outer jack.

22. The roof jack apparatus of claim 12 wherein said outer jack is rotated about said inner jack.

* * * * *